US005673880A

United States Patent [19]

Dexter, Jr.

[11] Patent Number: 5,673,880

[45] Date of Patent: Oct. 7, 1997

[54] TOOTHPASTE TUBE HOLDER

[76] Inventor: Fred E. Dexter, Jr., P.O. Box 423, Red Hook, N.Y. 12571

[21] Appl. No.: 189,280

[22] Filed: Feb. 1, 1994

[51] Int. Cl.[6] ..... B65D 35/56

[52] U.S. Cl. ..... 248/109; 248/101

[58] Field of Search ..... 248/108, 109

[56] References Cited

U.S. PATENT DOCUMENTS

| | | | |
|---|---|---|---|
| D. 88,288 | 8/1932 | Gunnison . | |
| D. 225,497 | 12/1972 | Smith . | |
| D. 256,411 | 8/1980 | Neuman . | |
| D. 293,532 | 1/1988 | Sussman . | |
| D. 312,546 | 12/1990 | Goldenberg et al. . | |
| 1,252,051 | 1/1918 | Stone . | |
| 1,320,275 | 10/1919 | Roa | 248/108 |
| 1,620,748 | 3/1927 | Baker | 248/109 |
| 1,654,549 | 1/1928 | Mohun | 248/109 |
| 1,828,154 | 10/1931 | Siqveland | 248/108 |
| 1,833,608 | 11/1931 | Gunnison | 248/109 |
| 2,034,774 | 3/1936 | Staeheli | 248/108 |
| 2,391,528 | 12/1945 | Walker et al. | 248/108 |
| 2,600,553 | 6/1952 | Lord | 248/108 |
| 3,178,060 | 4/1965 | Bossack | 248/109 |

FOREIGN PATENT DOCUMENTS

| | | | |
|---|---|---|---|
| 797855 | 2/1936 | France | 248/108 |
| 1377906 | 4/1964 | France | 248/109 |

*Primary Examiner*—Leslie A. Braun

*Attorney, Agent, or Firm*—Schmeiser, Olsen & Watts

[57] ABSTRACT

A toothpaste tube holder 10 is disclosed for holding a toothpaste tube 50 when either full or rolled. The toothpaste tube holder 10 includes slots 20 for ease of access of the toothpaste tube 50 and for providing a wedging action for securely holding the toothpaste tube 50 in a rolled-up position when not in use.

8 Claims, 1 Drawing Sheet

TOOTHPASTE TUBE HOLDER

This invention relates generally to a holder for collapsible tubes. In particular, this invention relates to a holder for a toothpaste tube.

BACKGROUND OF THE INVENTION

The prior art discloses collapsible tube or toothpaste tube holders having various features for holding the tube when not in use. A difficulty with these prior art devices is that they do not compensate for holding the tube in a collapsed condition. As the material, such as toothpaste, is squeezed from the collapsible tube, the bottom of the tube is rolled. If the holder does not have inner side walls to conform to a rolled tube, the tube unravels when it is returned to the holder.

Sussman, U.S. Pat. No. D293,532 discloses a combined toothbrush tumbler and toothpaste holder. The portion of the holder for holding the toothpaste in this prior art reference has inner sidewalls which do not compensate for a toothpaste tube which has been rolled. A rolled tube would fit loosely within the holder and thus would unravel. Additionally, in a rolled condition, the tube may only be accessed through a top opening which does not provide convenient access for the user.

Goldenberg, U.S. Pat. No. D312,546 discloses a toothpaste tube holder having a front downwardly extending slot, this tube holder has the drawback of a nonconforming inside thus allowing the tube to unravel.

U.S. Pat. No. D88,288 to Gunnison shows a collapsible tube support with a tapered receiver for holding a tube in what appears to be a sideways position. U.S. Pat. No. D225,497 to Smith shows a tapered toothpaste tube holder having an open bottom and a plurality of hooks for attachment to a vertical support such as a wall. U.S. Pat. No. 1,252,051 to Stone discloses a carton case made of a cardboard or a fiber board blank and used as an outer covering for collapsible tubes containing pastes, creams and other semi-liquids. The carton case assists in maintaining its shape due to its stiffness when exerting pressure upon the faces of the wedge. U.S. Pat. No. D256,411 discloses a tube holder having a plurality of vertically offset parallel sheets with rounded openings for toothpaste tubes or other squeezable tubes.

SUMMARY OF THE INVENTION

The present invention includes all the advantages of the prior art references while overcoming the aforesaid disadvantages. In particular, the present invention includes a collapsible tube support having interior surfaces which are adapted for holding a full toothpaste tube and also compensating for variations in size as the tube is collapsed by rolling. More specifically, the inner surface of the present invention includes opposing concave surfaces which conform to the sides of a full toothpaste tube. Between the outer surface of the holder and the inner surface are a plurality of opposing slots. The slots permit the end of the tube opposite the cap to slide in and out of the holder in either a full or rolled condition. At the bottom of the slots and the inner surface is a notch which conforms to the end of a toothpaste tube in a full or rolled condition.

Another advantage of the present invention is providing a toothpaste tube holder which permits easy access to the user. Tapered slots in the side of the holder are provided for ease of access to a toothpaste tube (e.g, with a thumb and finger). The slots also assist in wedging the sides of the rolled toothpaste tube so that it does not become unraveled. The difficulty with the toothpaste tube unravelling is that the user must roll the tube before each use to squeeze the toothpaste therefrom.

BRIEF DESCRIPTION OF THE DRAWINGS

The character of the invention may be best understood by reference to one of its structural forms, as illustrated by the accompanying drawings.

DETAILED DESCRIPTION OF THE PREFERRED EMBODIMENT

In describing a preferred embodiment of the invention, specific terminology will be resorted to for sake of clarity. However, the invention is not intended to be limited to the specific terms so selected, and it is to be understood that each specific term includes all equivalents which operate in a similar manner to accomplish a similar purpose.

Figure 6:
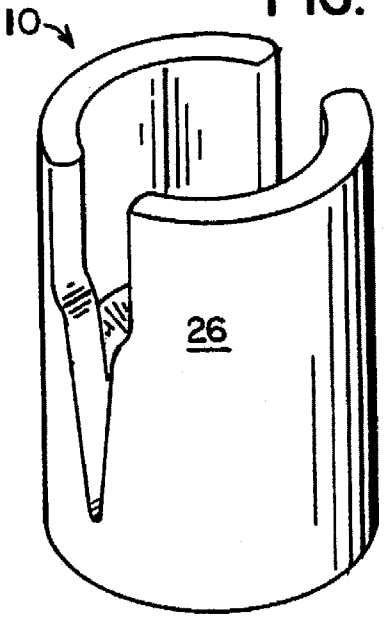
FIG. 6 is a perspective view of the toothpaste tube holder of the present invention.
Figure 1:
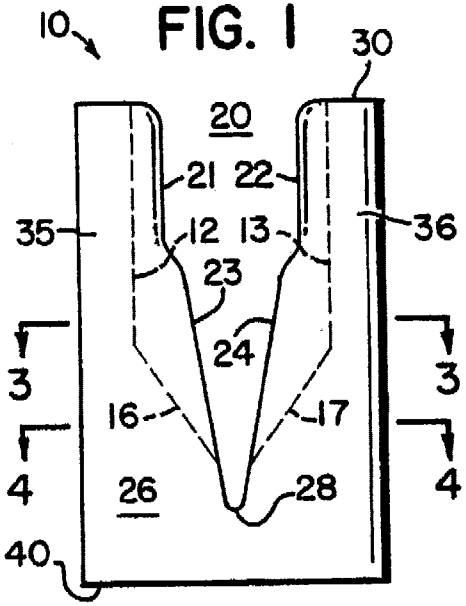
FIG. 1 is a side view of the present invention

FIG. 1 shows a side view and FIG. 6 shows a perspective view of the toothpaste tube holder 10 of the present invention. The tube holder 10 has an approximate height of 4½ inches. Referring to FIG. 1, the toothpaste tube holder 10 includes an upper surface 30, an outer surface 26 and a base surface 40 for supporting the holder 10. The outer surface 26 includes a first face 35 and a second face 36. The first 35 and second 36 face are shown as having rounded convex surfaces, however other shapes, such as polygonal, abstract or fanciful, are contemplated as being within the spirit of the present invention.

The upper surface 30 includes a toothpaste tube receiving cavity. The cavity includes a inner surface with a diameter of about 1½ inches and having inner surface side walls 12, 13, 16, 17 and opposing slots 20 having a height of between 2½ to 4 inches, most preferably 3¼ inches. The inner surface side walls 12, 13 define opposing concave surfaces or a noncontinuous cylindrical surface having vertically parallel side walls. The concave surfaces 12, 13 are described as noncontinuous cylindrical surfaces because they are interrupted by the opposing slots 20.

Figure 4:
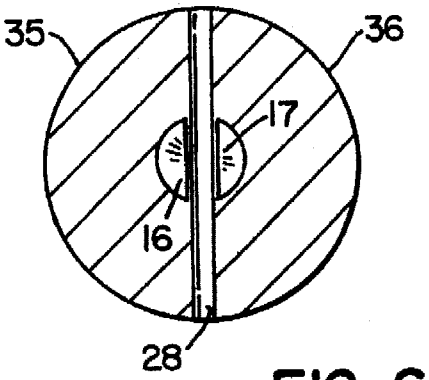
FIG. 4 is a section view taken through lines 4—4 of FIG. 1 of the present invention.
Figure 3:
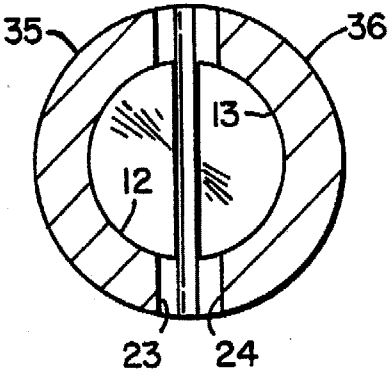
FIG. 3 is a section view taken through lines 3—3 of FIG. 1 of the present invention.
Figure 2:
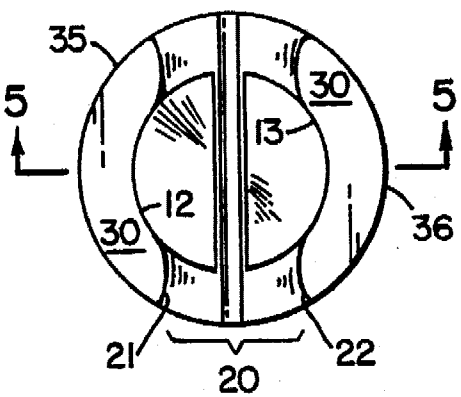
FIG. 2 is a top view of the toothpaste tube holder of the present invention.

Positioned below the inner surface side walls 12, 13, are noncontinuous cone or tapered shaped side walls 16, 17 converging toward said notch. As shown in FIGS. 2–4 a notch 28 is positioned below the cone shaped side walls 16, 17. The notch 28 is about 2 inches in length and extends the diameter the tube holder 10. The side walls 12, 16 are mirror images of the side walls 13, 17 and conform to a full or partially full toothpaste tube.

As shown in FIGS. 1–3 and 5–6, a slot 20 is positioned between the inner surface 12, 13, 16, 17 and the outer surface 26. The slot 20 includes parallel upper edges 21, 22. The surfaces are curvilinear when viewed from the top as shown in FIG. 2. The lower edges 23, 24 of the slot 20 are V-shaped or parabolic and end in notch 28.

FIG. 3 shows a cross-sectional view as taken through line 3—3 of FIG. 1. The distance between the concave inner surfaces 12, 13 of the core and the first 35 and second face 36 is constant.

FIG. 4 shows a cross-sectional view as taken through line 4— 4 of FIG. 1. The cross-sectional area of the distance between 35 and 16 and between 17 and 36 varies with vertical height.

Figure 5:
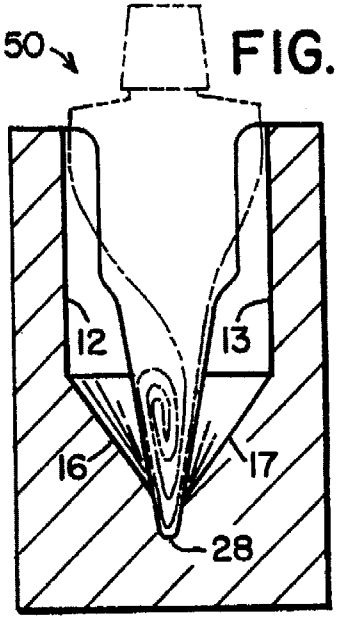
FIG. 5 is a sectional side view of the toothpaste tube holder of the present invention.

FIG. 5 is a cross-sectional view as taken through lines 5—5 in FIG. 2. As shown in phantom in FIG. 5, the V-shaped or parabolic slot 20 assists in wedging a rolled toothpaste tube 50.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A toothpaste tube holder comprising:

(a) a base;

(b) first and second opposing sections rigidly fixed to said base and being fixed relative to one another and adapted for receiving a toothpaste tube therebetween, each of said first and second sections including:

(1) an upper surface, (2) an outer surface, and (3) an inner surface opposite said outer surface, the inner surface having an upper portion with a partial-cylindrical surface, a central portion, and a lower portion, (4) a pair of side edges disposed between said outer surface and said inner surface;

wherein the inner surface of the first section is positioned opposite the inner surface of the second section, the inner surfaces of the first section and the second section converge downwardly towards one another such that each respective one of said pair of side edges of the first section and each respective one of said pair of side edges of said second section also converge so that a pair of slots are defined between said edges of said first and second section whereby when a rolled toothpaste tube is inserted between the first and second section, a cylindrical portion of the tube conforms to said partial-cylindrical surfaces and a bottom of the tube wedges within the slots.

2. The toothpaste tube holder of claim 1, wherein the central portion of said inner surface of each of said first and second sections further comprises a partial-conical surface positioned below said partial-cylindrical surface.

3. The toothpaste tube holder of claim 1, wherein the side edges of the lower portion of each inner surface form a notch at a lower portion of said slot.

4. The toothpaste tube holder of claim 1, wherein the side edges are parallel proximate the upper surface.

5. A toothpaste tube holder comprising:

(a) a base;

(b) first and second opposing sections rigidly fixed to said base and being fixed relative to one another and adapted for receiving a toothpaste tube therebetween, each of said first and second sections including:

(1) an upper surface, (2) an outer surface, and (3) an inner surface opposite said outer surface, the inner surface having an upper portion with a partial-cylindrical surface, a central portion having a partial-conical surface positioned below said partial-cylindrical surface, and a lower portion, (4) a pair of side edges disposed between said outer surface and said inner surface;

wherein the inner surface of the first section is positioned opposite the inner surface of the second section, the inner surfaces of the first section and the second section converge downwardly towards one another such that each respective one of said pair of side edges of the first section and each respective one of said pair of side edges of said second section also converge so that a pair of V-shaped slots are defined between the edges of the first and second sections whereby when a rolled toothpaste tube is inserted between the first and second section, a cylindrical portion of the tube conforms to said partial-cylindrical surfaces and a bottom of the tube wedges within the V-shaped slots.

6. The toothpaste tube holder of claim 5, wherein the upper surface of the first section is coplanar with the upper surface of the second section.

7. The toothpaste tube holder of claim 6, wherein the inner surfaces of said first and second sections are symmetrical.

8. The toothpaste tube holder of claim 7, wherein the side edges are parallel proximate the upper surface.

* * * * *